United States Patent [19]

Vermette

[11] 4,131,181

[45] Dec. 26, 1978

[54] PORTABLE LIFT

[76] Inventor: Howard H. Vermette, No. 7 - 143rd St., Hammond, Ind. 46320

[21] Appl. No.: 797,510

[22] Filed: May 16, 1977

[51] Int. Cl.[2] ..... B66B 9/20

[52] U.S. Cl. ..... 187/11; 187/1 R; 187/2

[58] Field of Search ..... 187/1 R, 2, 9 R, 9 E, 187/11; 254/190 R; 212/145; 214/750; 280/763; 182/17, 63, 141

[56] References Cited

U.S. PATENT DOCUMENTS

| | | | |
|---|---|---|---|
| 1,799,307 | 4/1931 | Manley | 187/11 |
| 2,196,634 | 4/1940 | Kuert | 187/11 |
| 2,402,579 | 6/1946 | Ross | 182/63 X |
| 2,477,167 | 7/1949 | Bliss | 214/750 |
| 2,495,804 | 1/1950 | Berchtold | 254/190 R X |
| 2,757,756 | 8/1956 | Warry | 187/11 |
| 3,587,892 | 6/1971 | Vermette | 187/11 X |
| 3,807,575 | 4/1974 | Merrick | 212/8 |
| 3,819,013 | 6/1974 | Crum | 187/11 |
| 3,957,137 | 5/1976 | Vermette | 187/11 |

*Primary Examiner*—Evon C. Blunk
*Assistant Examiner*—James L. Rowland
*Attorney, Agent, or Firm*—Vogel, Dithmar, Stotland, Stratman & Levy

[57] ABSTRACT

A portable lift for industrial uses in which an upright post is supported on a base and has a carriage slidably supported thereon. Load carrying members extend forwardly of the carriage and a pulley is mounted on the carriage and in a pulley housing mounted on top of the post. A winch is supported rearwardly of the post, and a cable passes from the winch through the pulley housing downwardly to and around the carriage pulley then upwardly through a conduit in the pulley housing and is tied off at the winch support. A brace extends downwardly from the winch support to the base thereby to provide counter acting balances for the load. The combination disclosed, permits loads twice the rated winch capacity to be lifted without rocking, tipping or other unwanted oscillatory movements in the device. Outriggers are pivotally mounted on the base and are movable between the storage position parallel to and adjacent to the base with the outrigger feet raised off the ground and a use position in which the outriggers extend laterally of the base with the feet in contact with the ground. Locking mechanism keep the outriggers in one of the use or storage positions.

7 Claims, 9 Drawing Figures

PORTABLE LIFT

BACKGROUND OF THE INVENTION

Portable lifts are widely used in industry for many lifting operations. The lift of the present invention is a hand propelled lift useful for lifting loads up to about 1,000 pounds although with heavier duty winches and braces, greater loads can be lifted. Generally, it has been impossible to provide a portable, manually operated lift in which the lifting capacity significantly exceeds the winch rating. Accordingly, in order to lift heavier loads, it was necessary to change winches and in some cases add further struts and braces. This obviously is a undesirable situation because it requires man hours to adjust or modify equipment in the field.

Another problem encountered in portable lifts of the type set forth, is in the outriggers necessary to balance the lift when it is lifting heavy loads. Many outriggers designs are cumbersome and require continual adjustment of the outrigger feet, since they tend to drag on the ground and either become worn or become difficult to move from the storage position to the use position and vice versa. Yet another problem in the art is unwanted shimming and oscillations at the pulley head when extra heavy loads are lifted.

The problems set forth above, including the ability to lift significantly more than the rated winch capacity and the difficulty in moving outriggers from between the storage and use positions thereof have been overcome by my present invention, which also provides a much steadier mechanism for lifting extra heavy loads, up to twice the rated winch capacity.

SUMMARY OF THE INVENTION

This invention pertains to a portable lift and more particularly to a lift in which loads about double the rated winch capacity may be lifted without altering the structure of the lift.

It is a principal object of the present invention to provide a lift which is capable of lifting about double the rated winch capacity.

Another object of the present invention is to provide a winch having outriggers movable between the storage and use positions without dragging the feet on the ground to facilitate the use of the outriggers.

Still another object of the present invention is to provide a lift of the type set forth, in which the load support member is provided with easily added extensions thereto.

A further object of the present invention is to provide a portable lift comprising a base having a pair of spaced sides, an upright post supported on said base, a carriage surrounding the post slidably supported thereon, a pulley mounted on the carriage, a load supporting member connected to the carriage and extending forwardly of the post, a pulley unit as a single integrally formed structure comprising an elongated pulley housing and a pulley within the housing and a cable guide separate from the pulley extending through the elongated pulley housing, the pulley housing extending rearwardly of the post forming a cantilever and supporting the pulley within the housing in substantial vertical alignment with the post, a winch supported on the post vertically intermediate the pulley housing and the base and extending rearwardly of the post, a cable connected to the winch and extending over the pulley in the pulley housing and extending forwardly and outwardly of the post and continuing downward around the pulley on the carriage then upwardly through the cable guide and thence downwardly to a connection point so that operation of the winch will through the cable cause the load supporting member to move up or down on the upright post, brace means extending substantially from the connection point to the base, the portion of the cable extending rearwardly of the post between the pulley and the winch in cooperation with the means connecting the winch support to the base providing a cantilever force which counter balances the force of the load at the front of the lift to permit lifting of loads twice the winch capacity.

A further object of the present invention is to provide a portable lift of the type set forth wherein there is further provided an outrigger pivotally mounted to each base side and having a ground engaging member at the distal end thereof, each outrigger being movable between the storage position parallel and adjacent the associated base side in which the ground engaging member is spaced from the ground and a use position in which the outrigger extends laterally of the base side and the ground engaging member in contact with the ground and locking means on each outrigger for locking the outrigger in the use position and the storage position.

A still further object of the present invention is to provide a portable lift having an outriggers of the type set forth wherein the pin pivotally mounting the outrigger of the base slants rearwardly toward the operator.

A final object of the present invention is to provide a lift of the type set forth wherein the pulley housing on the top of the upright post is provided with spaced apart pulleys on one side of the housing and a cable guide conduit mounted on the other side of the housing so as to prevent rocking, tilting and other unwanted oscillations and vibrations during the lifting of the load.

These and other objects of the present invention will be more readily understood by reference to the following specification taken in connection with the drawings, in which:

BRIEF DESCRIPTION OF THE PREFERRED EMBODIMENT

Figure 1:
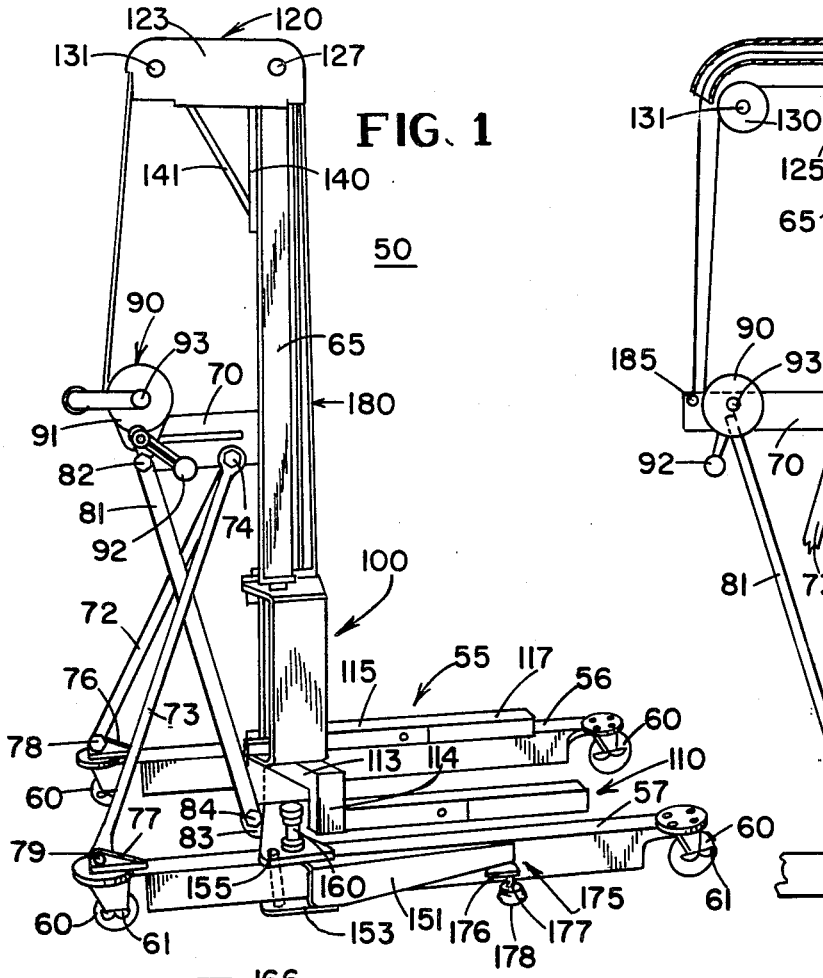
FIG. 1 is a perspective view of the portable lift forming the present invention.
Figure 2:
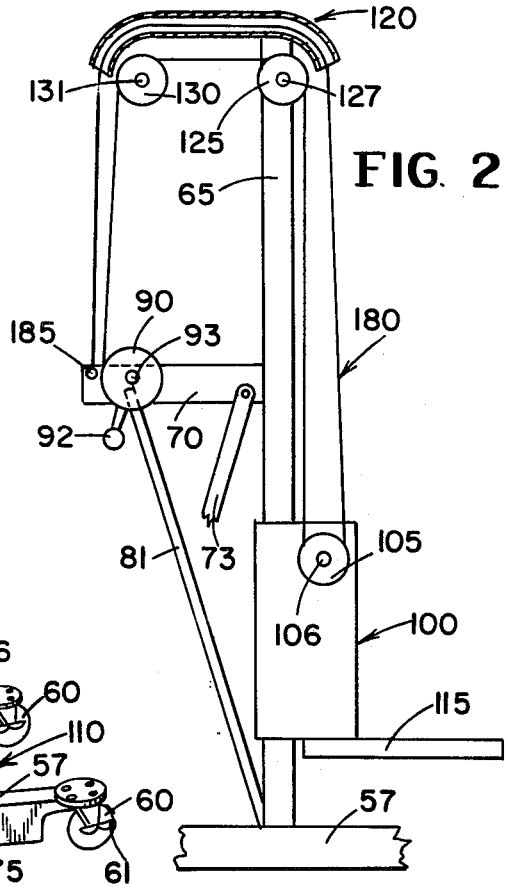
FIG. 2 is a schematic illustration of the post, winch, pulley housing and carriage of the present invention.
Figure 3:
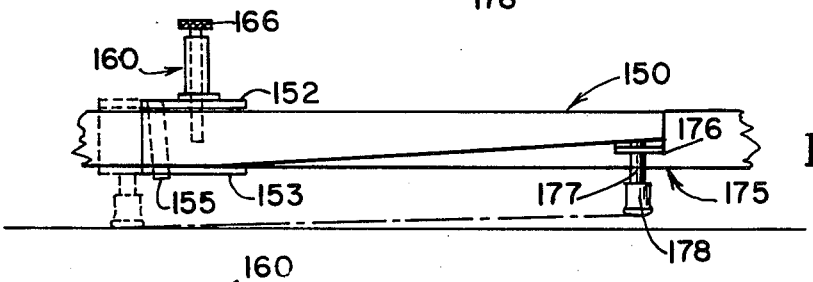
FIG. 3 is a side elevational view of the base and outrigger of the lift illustrated in FIG. 1, with the outrigger in the storage position thereof.
Figure 5:
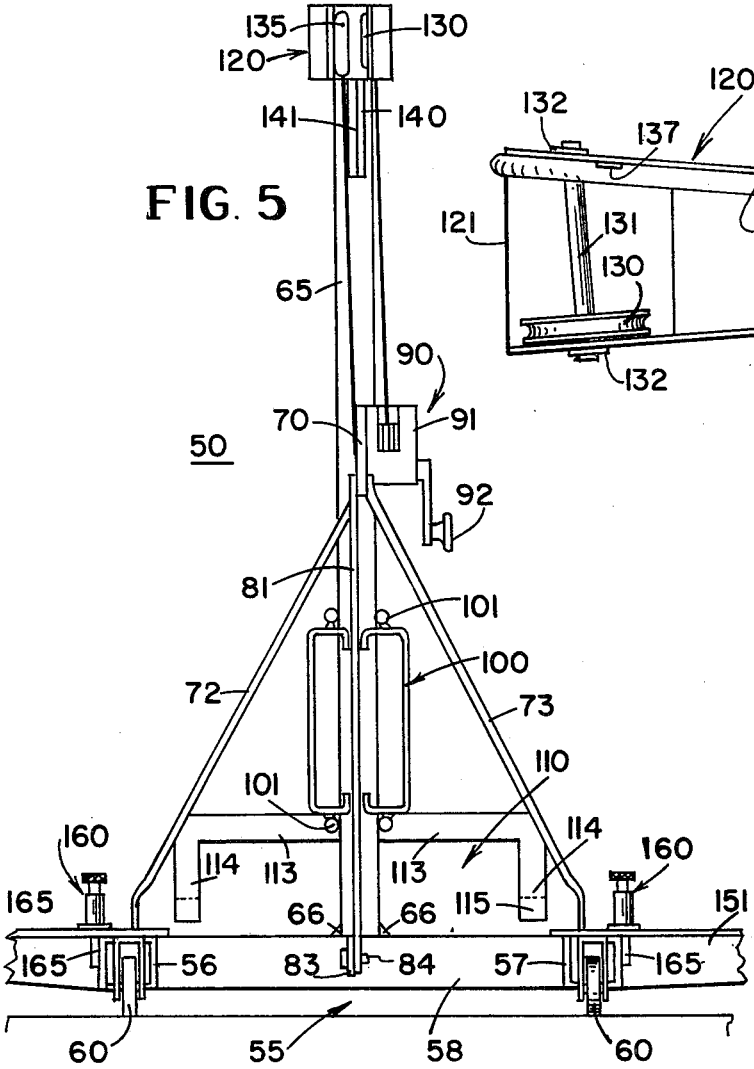
FIG. 5 is a rear elevational end view of the lift illustrated in FIG. 1.
Figure 6:
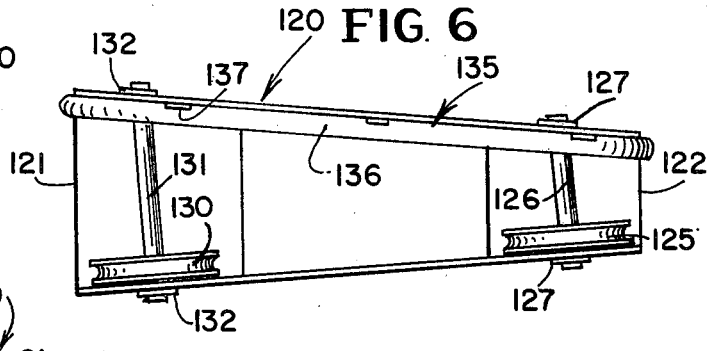
FIG. 6 is a top plan view of the pulley housing mounted on the post top.
Figure 7:
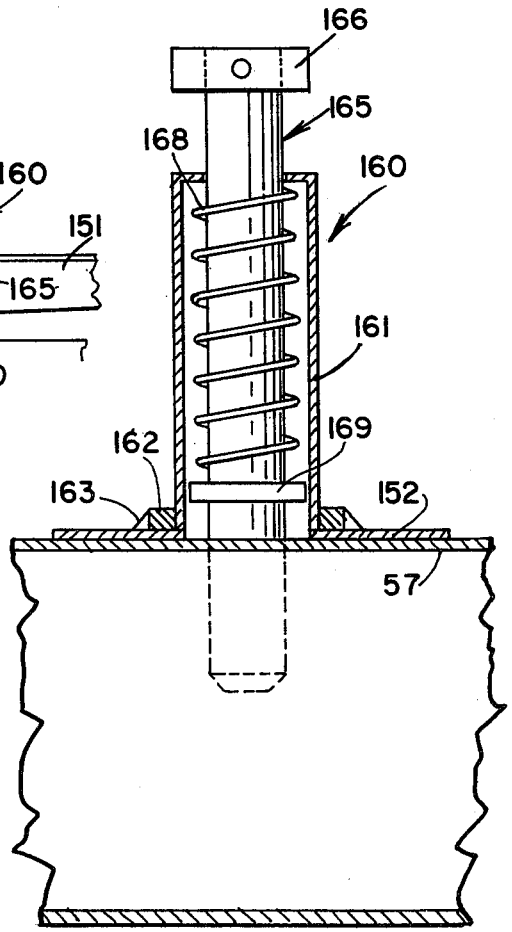
FIG. 7 is an enlarged sectional view of the locking mechanism associated with each outrigger.

Referring now to FIGS. 1 and 5, there is disclosed a lift 50 including a base 55 formed of spaced apart legs 56 and 57 interconnected by a cross bar 58, each of these members being rectangular tubing. Casters 60 are provided at the ends of each leg 56 and 57 and each caster 60 is provided with locking mechanism 61 therefor.

An upright post 65 is mounted onto the cross bar 58 and fixedly secured thereto as by welds 66. A winch support 70 extends rearwardly of the post 65. The winch support 70 may be secured to the post 65 by any suitable means such as welding or fasteners. Two brace members 72 and 73 are fixedly connected to the winch support 70 by a single common fastener 74, with each of the supports 72 and 73 extending respectively downwardly and outwardly toward the rear end of the associated leg 56 and 57. Leg 56 is provided with a mounting tab 76 extending upwardly therefrom which receives the brace 72 by means of a fastener 78. Similarly, a mounting tab 77 extends upwardly from the rear of the leg 57 and receives the brace 73 thereon by means of the fastener 79. A center brace 81 is fixedly secured to the distal end of the winch support 70 as at 82 and extends between the braces 72 and 73 downwardly to a mounting tab 83 on the cross bar 58 and is secured thereto by means of a fastener 94.

A winch 90 having a housing 91 is mounted on the winch support 70 and is provided with the usual turning handle 92 for turning the winch about the winch axis 93.

A carriage 100 is slidably mounted on the upright post 65 and may be of any particular design. The carriage is provided with four bearings 101, one on each side of the post at the top of the carriage and one on each side of the post at the bottom of the carriage. Rollers (not shown) are at the bottom, front and top rear of the carriage 100. A pulley 105 on an axle 106 is mounted centrally of the carriage 100, the pulley 105 being free to rotate about the axle in the usual manner.

Figure 8:
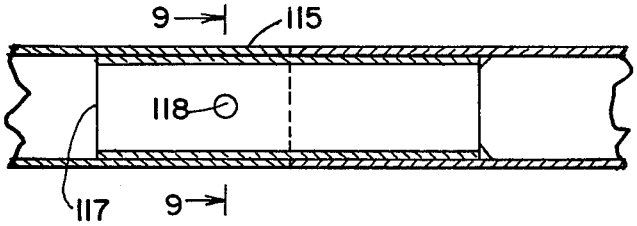
FIG. 8 is a sectional view of the load lifting arm and an extension therefor.
Figure 9:
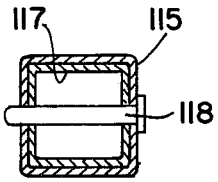
FIG. 9 is a view in section of FIG. 8 taken along line 9—9 thereof.

A load carrying member 110 is positioned at the bottom of the carriage 100 and includes a yoke 113 which has horizontally extending arms, each having a downwardly vertically extending leg 114. Load carrying members 115 respectively extend horizontally outwardly from the vertically extending leg 114. Each of the arms 115 may be extended by means of extensions 117 (see FIGS. 8 and 9) which are connected to the arms 115 by means of a pin or fastener 118.

Removably mounted on top of the upright post 65, is a pulley housing 120 tapered from the rear 121 thereof to the front 122 thereof, so that the transverse extent of the front 122 is greater than that of the rear 121. The housing also includes spaced apart side walls 123. A pulley 125 is mounted on an axle 126, extends horizontally through the sides 123 of the housing 120 and is maintained in the housing by lock washers 127. The axle 126 is mounted in alignment with the upright post 65 axis. A second pulley 130 is mounted on an axle 131 which extends through the side walls 123 of the housing 120 and is maintained therein by means of the lock washers 132. The axle 131 is positioned transversely between the post 65 and the winch axis 93. Each of the pulleys 125 and 130 is mounted adjacent one of the side walls 123. Adjacent the other side wall 123 is a cable guide 135. The cable guie 135 is a conduit 136 fixedly connected to the other side wall 123 by means of welds 137 or other suitable means.

The removable pulley housing 120 is provided with a downwardly extending support 140 which abuts the upright post 65. An angularly extending brace 141 is welded to a brace between the side walls 123 of the pulley housing 120 intermediate the axles 127 and 131 and extends forwardly and downwardly and is welded near the end of the downwardly extending brace 140.

Finally, the portable lift 50 is provided with two outriggers 150, each associated with a respective one of the base members 56 and 57. Only one outrigger 150 will be described, since they are identical in construction. The outrigger 150 includes a movable arm 151, which is housed between an upper mounting flange 152 and a lower mounting flange 153. The upper and lower mounting flanges 152 and 153 are interconnected by a pivot pin 155 which extends through the associated leg 56 or 57 and is tilted off the vertical toward the operator or the rear of the machine 50. The tilt of the pivot pin 155 is only a few degrees, but is critical to the operation of the outrigger 150. A locking mechanism 160 is provided on the upper mounting flange 152 and includes a tube 161 mounted above the flange 152 and secured thereto by means of a washer 162 and welds 163. The tube 161 is provided with a pin 165 slidably mounted within the tube 161 and provided with an outwardly extending top 166. A spring 168 is mounted in the tube 161 and bears against a washer 169 fixedly secured to the pin 165 and against the tube 161 top to bias the pin 165 downwardly.

Figure 4:
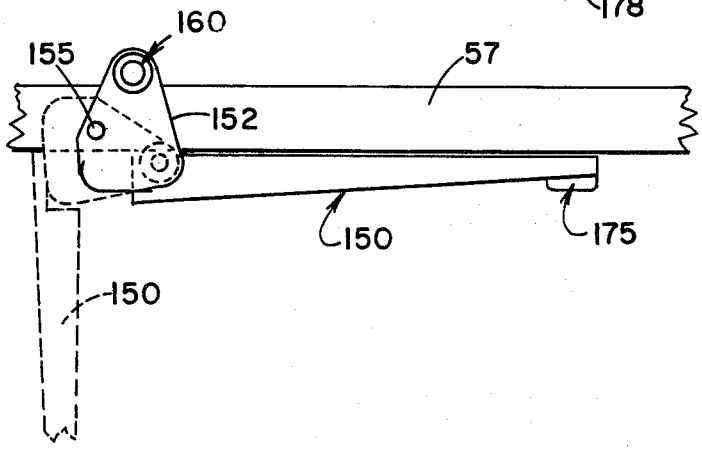
FIG. 4 is a top plan view of the base and outrigger illustrated in FIG. 3, showing the outrigger in solid line in the storage position thereof and in phantom in the use position thereof.

The locking mechanism 160 is positioned on the upper mounting flange 152 so that when the outrigger 150 is in the storage or full line position shown in FIG. 4, the locking pin 165 extends downwardly and contacts the inner edge of the leg 57 thereby locking the outrigger 50 in the storage position thereof. When the lock pin head 166 is manually raised, the outrigger 150 is free to move to the use position or dotted line position in FIG. 4, in which the arm 151 extends laterally of the base leg 57 and downward movement of the pin 165 results in locking the outrigger 150 in the use position thereof. Then the pin 165 bears against the outside surface of the base leg 57 and the edge of the outrigger arm 151 between the mounting flange 152 and 153 also bears against the outside edge of the base leg 57 thereby locking the outrigger in the use position thereof.

At the distal end of the arm 151, there is provided a ground support means 175, which is connected by means of a mounting flange 176 to the distal end of the arm 151. A leg 177 is threadably mounted in the flange 176 and is provided with a resilient foot 178. The leg 177 is adjustable so that it contacts the ground when the outrigger 150 is in the dotted line position shown in FIG. 4. Since the pivot pin 155 is rearwardly inclined, movement of the outrigger 150 from the use position thereof to the storage position thereof results in upward movement of the ground engaging member 175, thereby elevating same above the ground in the storage position thereof providing easy movement of the portable lift 50.

Finally, a cable 180 is provided and has a fixed connection point 185 at the distal end of the winch support 70 near the winch and approximately on the same plane as the winch axle 93. The cable 180 extends from the connection point 185 upwardly through the cable guide 135 downwardly to the pulley 105 and thence upwardly and over the pulleys 125 and 130 and then downwardly to the winch 90. Operation of the winch by rotating the handle 92 causes the carriage 100 to move upwardly and downwardly along the upstanding post 65.

Critical features of the present invention reside in the connection point 185 of the cable 180, which in cooperation with the center brace 81 permits loads twice the winch rated capacity to be lifted with the lift 50 of the present invention. It is required that the cable 180 either extend downwardly to the base 55 or a suitable brace such as 81 provide the additional extension between the winch support 70 and the base 55, thereby to permit lifting of double the winch capacity.

Another extremely important feature of the present invention is the provision of the pulley on the carriage 100 and the double pulleys 125 and 130 in the housing 120. The provision of the pulleys 125 and 130 on one side wall of the tapered housing 120 in combination with the cable guide 135, provide balance and prevent unwanted oscillation and vibrations during movement of the carriage 100 vertically along the post 65 under heavy loads. Without the combination of cable guide 135 with the friction of the cable 180 passing therethrough and multiple pulleys 105, 125 and 130, unwanted vibrations can often cause the load which is being lifted to shift with the attendant danger that it may fall off the load supporting arms 115 and injure personnel.

Another feature of the present invention which is extremely important to the operation with high loads, is the easy movability of the outriggers 150 between the storage and use positions thereof. The locking mechanism 160 serves to lock the outriggers 150 in either the storage position or the use position thereof. This locking capability in cooperation with the easy movement of the arm 151 between the storage and use positions thereof, greatly eases the operation of the outriggers 150, which results in their being used more often by the lift operator. When lifting high loads, it is imperative that the outriggers 150 be positioned in the use position (the phantom line in FIG. 4), and locked. The position of the pivot pin 155 which results in the easy movement between the storage and use positions is a great improvement over the prior art constructions, and the locking mechanisms 160 also enable easy and rapid use of the outriggers.

Another important feature of the present invention is the extension 117 provided for the load carrying arms 115. Since the lift 50 of the present invention is constructed to lift double winch capacity loads, it is often necessary to provide easy snap on arm extensions. The tubular construction of the arms 115 and the extensions 117 permit rapid additions to the load lifting arms 115. The braces 140 and 141 provide the necessary strength and stability to the pulley housing 120 when the extra heavy loads capable of being lifted with the present invention are in use.

While there has been described what is at present considered to be the preferred embodiment of the present invention, it will be understood that various modifications and alterations may be made therein without departing from the true spirit and scope of the subject invention, and it is intended to cover in the appended claims all such alterations and modifications made therein.

What is claimed is:

1. A portable lift comprising, a base, a single upright post supported on said base, a carriage surrounding said post slidably supported thereon, a pulley mounted on said carriage, a load supporting member connected to said carriage and extending forwardly of said post, a pulley unit as a single integrally formed structure comprising an elongated pulley housing and a pulley within said housing and a cable guide separate from said pulley extending through said elongated pulley housing, said pulley housing extendng rearwardly of said post forming a cantilever and supporting said pulley within said housing in substantial vertical alignment with said post, a winch supported on said post vertically intermediate said pulley housing and said base and extending rearwardly of said post, a cable connected to said winch and extending over said pulley in said pulley housing and extending forwardly and outwardly of said post and continuing downward around said pulley on said carriage then upwardly through said cable guide and thence downwardly to a connection point on said winch support rearwardly of said winch so that operation of said winch will through said cable cause said load supporting member to move up or down on said upright post, brace means coplanar with said upright post extending substantially from said connection point forwardly and downwardly to said base, spaced apart braces connected to said winch support near said upright extending rearwardly and downwardly toward the rear of said base, said brace means extending between said spaced apart braces, the portion of said cable extendng rearwardly of the post between said pulley and said winch in cooperation with said means connecting said winch support to said base providing a cantilever force which counter balances the force of the load at the front of the lift to permit lifting of loads twice the winch capacity.

2. The portable lift set forth in claim 1, wherein two pulleys are provided in said pulley housing.

3. The portable lift set forth in claim 2, wherein one pulley in said pulley housing is positioned on a vertical line intermediate said winch axle and said post.

4. The portable lift set forth in claim 1, wherein said cable guide is a conduit fixedly mounted in said pulley housing.

5. The portable lift set forth in claim 1, wherein said pulley housing is tapered in top plan view from back to front and is provided with spaced apart pulleys mounted on one side wall thereof and a conduit cable guide mounted on the other side wall thereof.

6. A portable lift comprising, a base having a pair of spaced sides, an upright post supported on said base, a carriage surrounding said post slidably supported thereon, a pulley mounted on said carriage, a load supporting member connected to said carriage and extending forwardly of said post, a pulley unit as a single integrally formed structure comprising an elongated pulley housing and a pulley within said housing and a cable guide separate from said pulley extending through said elongated pulley housing, said pulley housing extending rearwardly of said post forming a cantilever and supporting said pulley within said housing in substantial vertical alignment with said post, a winch supported on said post vertically intermediate said pulley housing and said base and extending rearwardly of said post, a cable connected to said winch and extending over said pulley in said pulley housing and extending forwardly and outwardly of said post and continuing downward around said pulley on said carriage then upwardly through said cable guide and thence downwardly to a connection point so that operation of said winch will through said cable cause said load supporting member to move up or down on said upright post, brace means extending substantially from said connection point to said base, the portion of said cable extending rearwardly of the post between said pulley and said winch in cooperation with said means connecting said winch support to said base providing a cantilever force which counter balances the force of the load at the front of the lift to permit lifting of loads twice the winch capacity, and an outrigger pivotally mounted to each base side by a rearwardly slanting pin and having a ground engaging member at the distal end thereof, each outrigger being movable between a storage position parallel and adjacent the associated base side in which said ground engaging member is spaced from the ground and a use position in which said outrigger extends laterally of said base side with said ground engaging member in contact with the ground, and locking means on each outrigger for locking said outrigger in the use position thereof.

7. The portable lift set forth in claim 6, wherein said locking means includes a spring biased pin continually urged downwardly to lock said outrigger in either the storage position thereof or the use position thereof.

* * * * *